US005115831A

United States Patent [19]

Stroze et al.

[11] Patent Number: 5,115,831

[45] Date of Patent: May 26, 1992

[54] ADAPTIVE STEPPED COMPENSATOR VALVE

[75] Inventors: Mrk S. Stroze, Rockford; Kenneth C. Spurbeck, Stillman Valley, both of Ill.

[73] Assignee: Sundstrand Corporation, Rockford, Ill.

[21] Appl. No.: 653,948

[22] Filed: Feb. 12, 1991

[51] Int. Cl.[5] ..... F01B 13/00

[52] U.S. Cl. ..... 137/102; 91/473

[58] Field of Search ..... 91/473; 137/102, 106

[56] References Cited

U.S. PATENT DOCUMENTS

| | | | |
|---|---|---|---|
| 3,017,897 | 1/1962 | Seguenot | 137/529 |
| 3,156,159 | 11/1964 | Cadiou | 91/473 |
| 3,208,396 | 9/1965 | Budzich | 91/473 X |
| 3,384,102 | 5/1968 | Hickox | 137/102 X |
| 3,418,941 | 12/1968 | Mowbray | 91/473 |
| 3,706,322 | 12/1972 | Carlson | 137/625 |
| 3,980,001 | 9/1976 | Cyphelly | 137/106 X |
| 4,187,884 | 2/1980 | Loveless | 137/625.69 |
| 4,649,957 | 3/1987 | Quinn | 137/625.64 |

*Primary Examiner*—Robert G. Nilson

*Attorney, Agent, or Firm*—Antonelli, Terry Stout & Kraus

[57] ABSTRACT

An adaptive stepped compensator valve for controling hydromechanical control apparatus having high and low pressure control lines. The adaptive stepped compensator valve includes a housing having an elongated bore and a plurality of ports formed therein, a sleeve, disposed in sealed slidable engagement with the housing in the bore, and having an opening formed therein extending the length of the sleeve and direct acting main and balance spools disposed in the opening. High pressure fluid is inputed into a first chamber of the valve formed by the main spool and a second chamber formed by a balance spool. Low pressure fluid is inputted into a third chamber formed by an end of the main spool which abuts an end of the balance spool. The invention outputs a control signal based upon a detected difference in pressure between the high pressure fluid and the low pressure fluid. An adaptive operation of the valve is accomplished by axial movement of the sleeve which controls the amount of fluid outputted as a control signal by the valve. Stepped operation of the valve is accomplished by balancing the valve by inputting high pressure fluid in the first and second chambers of the valve.

16 Claims, 2 Drawing Sheets

ADAPTIVE STEPPED COMPENSATOR VALVE

TECHNICAL FIELD

The present invention relates to compensator valves for controlling the operation of hydraulic motor systems. More particulary, the present invention relates to an adaptive stepped compensator valve for controlling high hydraulic pressures which control the operation of a hydraulic motor wherein the adaptive stepped compensator valve is small relative to conventional valves and adapts to varying pressures.

BACKGROUND ART

As is well known in the art that hydromechanical control systems including compensator valves are used to control the operation of hydraulic motors by sensing pressure differences across the control ports of the hydraulic motor. Such a conventional hydromechanical control system is shown in FIG. 1.

The compensator valve of the conventional hydromechanical control system shown in FIG. 1 is designed to sense the pressure difference across the motor control ports of the hydraulic motor.

The conventional hydromechanical control system shown in FIG. 1 particularly provides a direct acting compensator valve 10 which performs the control function based upon the difference in pressure between low pressure fluid flowing from a low pressure control flowing to the high pressure control port 13 of the motor.

The high pressure fluid flowing to the high pressure control port 13 of the motor is supplied to high pressure input 14 of the valve 10 and the low pressure fluid from the low pressure control port 11 of the motor is supplied to low pressure input 15 of the valve 10.

The compensator valve 10 shown in FIG. 1 detects the difference between the high pressure input 14 and the low pressure input 15 and provides a control signal through control ports 11 and 13 which actuates the hydraulic motor control piston at some predetermined design pressure thereby controlling the apparatus being controlled. Particularly, the control signal feeds hydraulic fluid to the control piston of the hydraulic motor 12 which then varies the displacement of the hydraulic motor 11.

To complete the hydraulic loop a fluid return 16 is also provided in the system for returning excess fluid to a fluid reservoir.

The compensator valve 10 shown in FIG. 1 provides a housing having an elongated bore 17 formed therein. A plurality of openings are formed in the housing corresponding to the high and low pressure input ports 14 and 15. The high pressure input port 14 inputs high pressure fluid at a first end of the bore 17. The high pressure control port 13 is also at the first end of the bore 17. The low pressure input port 15 inputs low pressure fluid from the low pressure control port 11 of the motor into a low pressure chamber which communicates with a second end of the elongated bore 17.

A spool 18, movably positioned in an axial direction in sealed slidable engagement in the elongated bore 17, forms a high pressure first chamber at the first end of the elongated bore 17.

A portion of the spool 18 is disposed near the opening to the high pressure control port 13 such that the spool 18 when moved controls the flow of fluid through the opening to the high pressure control port 13. The movement of the spool 18 occurs in response to a difference in pressure between the high and low pressure fluids supplied by the high and low pressure inputs 14 and 15.

A large spring 20 is provided in the low pressure chamber. The large spring 20 biases the spool 18 against forces generated by the high pressure fluid in the high pressure chamber at the first end of the elongated bore 17.

The compensator valve 10 operates by detecting predetermined differences in pressure between the high pressure fluid and the low pressure fluid. A detected difference between the high pressure fluid and low pressure fluid of a predetermined amount causes movement of the spool 18 in the axial direction thereby varying the opening of the high pressure control port 13. By varying the opening of the high pressure control port 13 the pressure and flow of the control signal output thereby is varied.

The large spring 20 is used to supplement the force generated by the low pressure fluid in the low pressure chamber by biasing the spool 18 against the force generated by the high pressure fluid in the high pressure chamber. Such biasing of the spool 18 against the force generated by the high pressure fluid aids in detecting the difference in pressure of a predetermined amount between the high pressure fluid and the low pressure fluid. Further, due to the much greater force generated by the high pressure fluid relative to the low pressure fluid, it is necessary that the large spring 20 be of sufficient size to adequately supplement the force generated by the low pressure fluid so that a balance is established in the valve for reasonably responsive functioning.

The conventional compensator valve shown in FIG. 1 works well when used in 1,000–5,000 psi hydraulic systems. Moderately sized large springs can be designed to withstand such pressures and balance the forces generated by the high and low pressure fluids.

However, the conventional compensator valve shown in FIG. 1 suffers from the disadvantage of not working well in high pressure hydraulic systems that operate between 5,000–8,000 psi. The size of the spring needed to balance pressures between 5,000–8,000 psi would be extremely large. A valve using an extremely large spring for balancing is unacceptable in designs where space is at a premium. Further, the valve, due to its size, may not be as responsive as desired.

Various other conventional compensator valves have been proposed. Such conventional compensator valves are disclosed in U.S. Pat. Nos. 3,017,897; 3,706,322; 4,187,884 and 4,649,957.

The conventional compensator valves disclosed by the above-referenced patents suffer from the disadvantage of not adequately addressing the problems associated with providing a compensator valve for a high pressure hydromechanical control system that is relatively small in size.

DISCLOSURE OF INVENTION

The present invention provides an adaptive stepped compensator valve for a high variable pressure hydromechanical control system that is small in size relative to conventional compensator valves.

In addition, the present invention provides an adaptive stepped compensator valve which primarily makes use of the high pressure fluid supplied to the motor to balance the valve.

Further, the present invention provides an adaptive stepped compensator valve for a high variable pressure hydromechanical control system that operates well with systems operating in the range of 5,000–8,000 psi.

Still further, the present invention provides an adaptive stepped compensator valve for a high variable pressure hydromechanical control system which is small in size relative to conventional direct acting compensator valves and makes use of the high pressure fluid to balance the valve.

The adaptive stepped compensator valve of the present invention includes a housing having an elongated bore formed therein and a plurality of ports formed in the housing.

A first input port is provided for inputting a first portion of a flow of high pressure fluid at a first end of the elongated bore. A second input port is provided for inputting a second portion of the flow of high pressure fluid at a second end of the elongated bore. A third input port, disposed between the first and second input ports, is provided for inputting a first portion of a flow of low pressure fluid. A control port, disposed between the first and second input ports, is provided for outputting a control fluid to control the operation of the motor thereby controlling a load. A return port, disposed between the third input and control ports, is provided for returning fluid to a fluid reservoir.

The adaptive stepped compensator valve of the present invention includes a sleeve movably positioned in an axial direction in the elongated bore. The sleeve is disposed in sealed slidable engagement with the housing. The sleeve includes a plurality of channels for correspondingly communicating with the third input port, the control port and the return port.

Stroke and destroke control channels are provided in spaced apart relationship to each other in the sleeve. The control channels communicate with stroke and destroke control ports in the housing. The stroke and destroke control ports communicate with the control port. A return channel is provided in the sleeve for communicating with the return port. The return channel is designed to always remain in communication with the return port when the sleeve is moved. A third input channel is provided in the sleeve for communicating with the third input port. The third input channel is designed to always remain in communication with the third input port when the sleeve is moved.

The sleeve has an opening formed therein extending the length of the sleeve. Disposed in the opening of the sleeve are a direct acting main spool and balance spool. The balance spool has a diameter smaller than the main spool.

The main spool is movably positioned in the axial direction in the opening of the sleeve and is disposed in sealed slidable engagement with the sleeve to form a first chamber in the first end of the elongated bore. The main spool controls the flow of fluid through the stroke and destroke control channels by opening one of the control channels and closing the other control channel when the main spool is axially moved relative to the sleeve and varying the opening of the opened control channel. The high pressure fluid inputted by the first input port into the first chamber of the elongated bore generates a first force which is applied to the main spool and the sleeve in a first direction.

A first end of the balance spool abuts the first end of the main spool. The balance spool is movably positioned in an axial direction in the opening of the sleeve and is disposed in sealed slidable engagement with the sleeve to form a second chamber in the second end of the elongated bore. High pressure fluid inputted by the second input port into the second chamber of the elongated bore generates a second force which is applied to the balance spool and the sleeve in a second direction opposite to that of the first direction of the first force.

The adaptive stepped compensator valve of the present invention also includes a first small spring having a first end which abuts a second end of the balance spool, for balancing the valve by generating a force to bias the balance spool against forces applied to the balance spool in the first direction. The first small spring is provided to balance or fine tune the valve. The second end of the first small spring abuts restraining apparatus integral with the sleeve including an extending portion and a ring attached thereto. The extending portion extends from the sleeve and the first end of the first small spring abuts the ring.

The first end of the main spool which abuts the first end of the balance spool is indented forming a third chamber with the sleeve and the first end of the balance spool. Low pressure fluid is inputted into the third chamber from the third input port. The low pressure fluid in the third chamber generates forces which are applied to the main spool in the second direction and to the balance spool in the first direction.

A middle portion of the main spool is also indented forming a fourth chamber with the sleeve into which is inputted fluid from the return port.

Optionally a fourth input port may be formed in the housing for inputting a second portion of the flow of low pressure fluid. The fourth input port communicates with a fifth chamber formed between the sleeve and the housing by an indentation in the sleeve. When the low pressure fluid exceeds a predetermined pressure forces in the fifth chamber cause movement of the sleeve relative to the spools to thereby vary the amount of fluid flowing from the stroke or destroke control channels to the stroke or destroke control ports.

A second small spring may be provided in the first chamber abutting a ledge portion of the sleeve to bias the sleeve against the forces applied to the sleeve in the second direction. The second small spring is provided to aid in balancing or finely tuning the adaptive stepped compensator valve of the present invention.

The adaptive stepped compensator valve of the present invention provides adaptive and stepped operational features. Basically, the present invention operates by detecting predetermined differences in pressure between the low pressure fluid and the high pressure fluid. Detected differences in pressure between the low pressure fluid and the high pressure fluid causes the main and balance spools to move in the axial direction, thereby opening either the stroke or destroke control channels and closing the other control channel and varying the opening of the opened control channel. Opening either of the control channels and closing the other control channel and varying the opening of the opened control channel varies the pressure of the fluid outputted by the control port. A variance in the pressure of the fluid output by the control port controls the operation of the hydraulic motor.

The adaptive operation features of the present invention is accomplished by movement of the sleeve which varies the amount of fluid permitted to flow from the stroke or destroke control channels to the stoke or destroke control ports. Varying the above described fluid flow permits the present invention to easily adapt to varying control pressures.

The stepped operational feature of present invention is accomplished by a balancing force being exerted by use of the balance spool. The balance force is applied in the second direction to the main spool. The force is caused by the high pressure fluid in the second chamber of the valve generates the balance force. Thus, the high pressure fluid is used to balance the valve, thereby eliminating the requirement of an extremely large spring to perform such balancing. Therefore, the present invention can effectively operate in the range of 5,000–8,000 psi.

BRIEF DESCRIPTION OF THE DRAWINGS

The features of the present invention which are believed to be novel are set forth with particularity in the appended claims. The invention may be best understood, however, by reference to the following description in conjunction with the accompanying drawings in which:

BEST MODE FOR CARRYING OUT THE INVENTION

Figure 1:
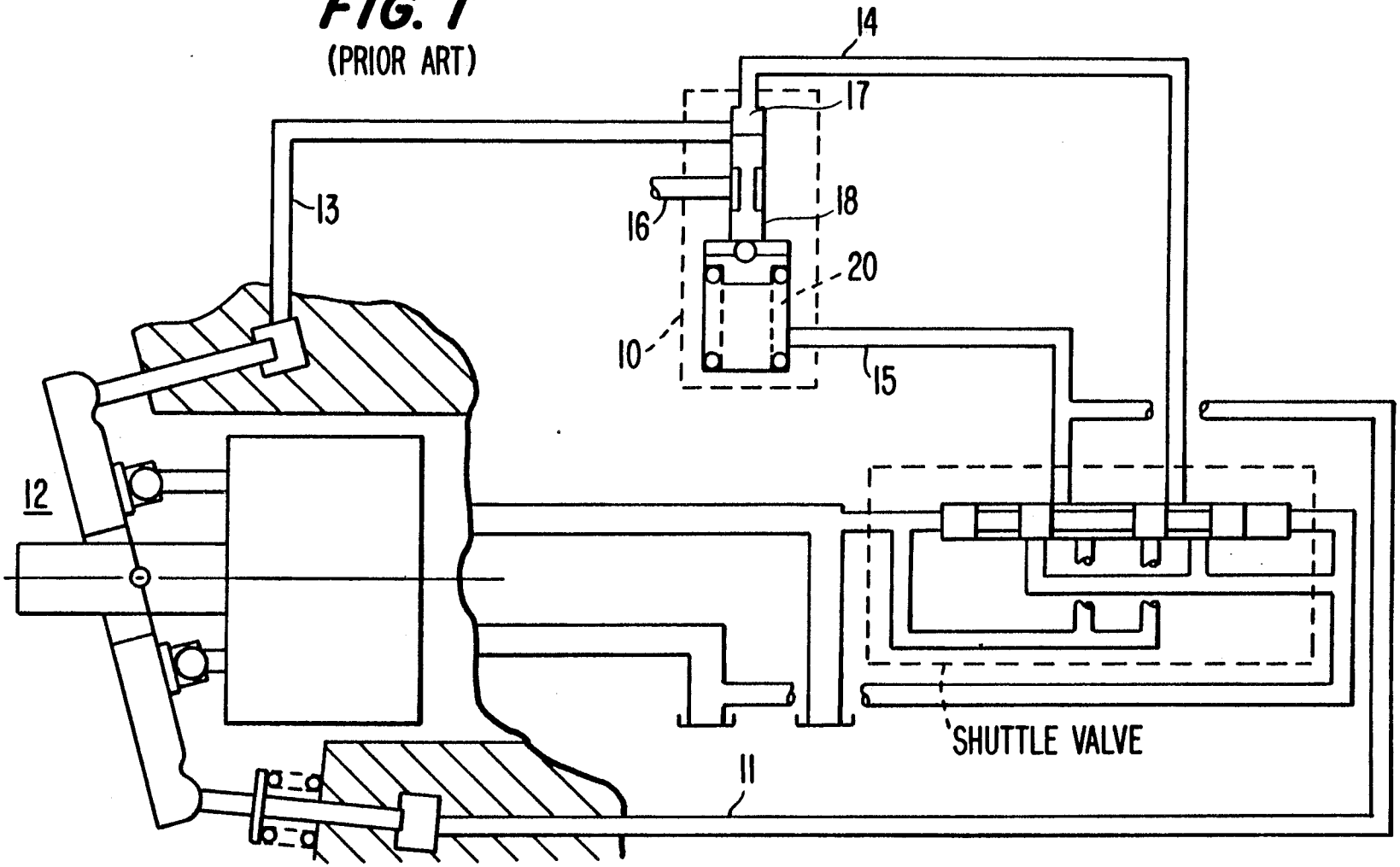
FIG. 1 (PRIOR ART)
FIG. 1 illustrates a conventional adaptive hydromechanical control system with a direct acting compensator valve.

FIG. 1 illustrates a conventional hydromechanical control system having a conventional direct acting compensator valve 10. The conventional direct acting compensator valve 10 controls a hydraulic motor 12 in response to differences in pressure between the high pressure fluid provided on high pressure input 14 and the low pressure fluid provided on low pressure input 15. In response to the high and low pressures the conventional direct acting compensator valve 10 output control signals through control outputs 11 and 13

The conventional direct acting compensator valve 10 suffers from the disadvantage of requiring an extremely large spring 20 to bias the spool 18 against the force generated by the high pressure fluid in the first end of the elongated bore 17.

The size of the spring 20 required by the conventional direct acting compensator valve 10 becomes even larger when the direct acting compensator valve 10 is used in a high pressure hydromechanical control system operating in the range of 5,000–8,000 psi.

The adaptive step compensator valve of the present invention overcomes the above-described disadvantage of the conventional direct acting compensator valve by providing an adaptive stepped compensator valve having an adaptive operational feature which permits the present invention to adapt to varying pressures and a stepped operational feature which permits the balancing of the valve of the present invention by the use of the high pressure fluid at opposite ends of the valve.

Figure 2:
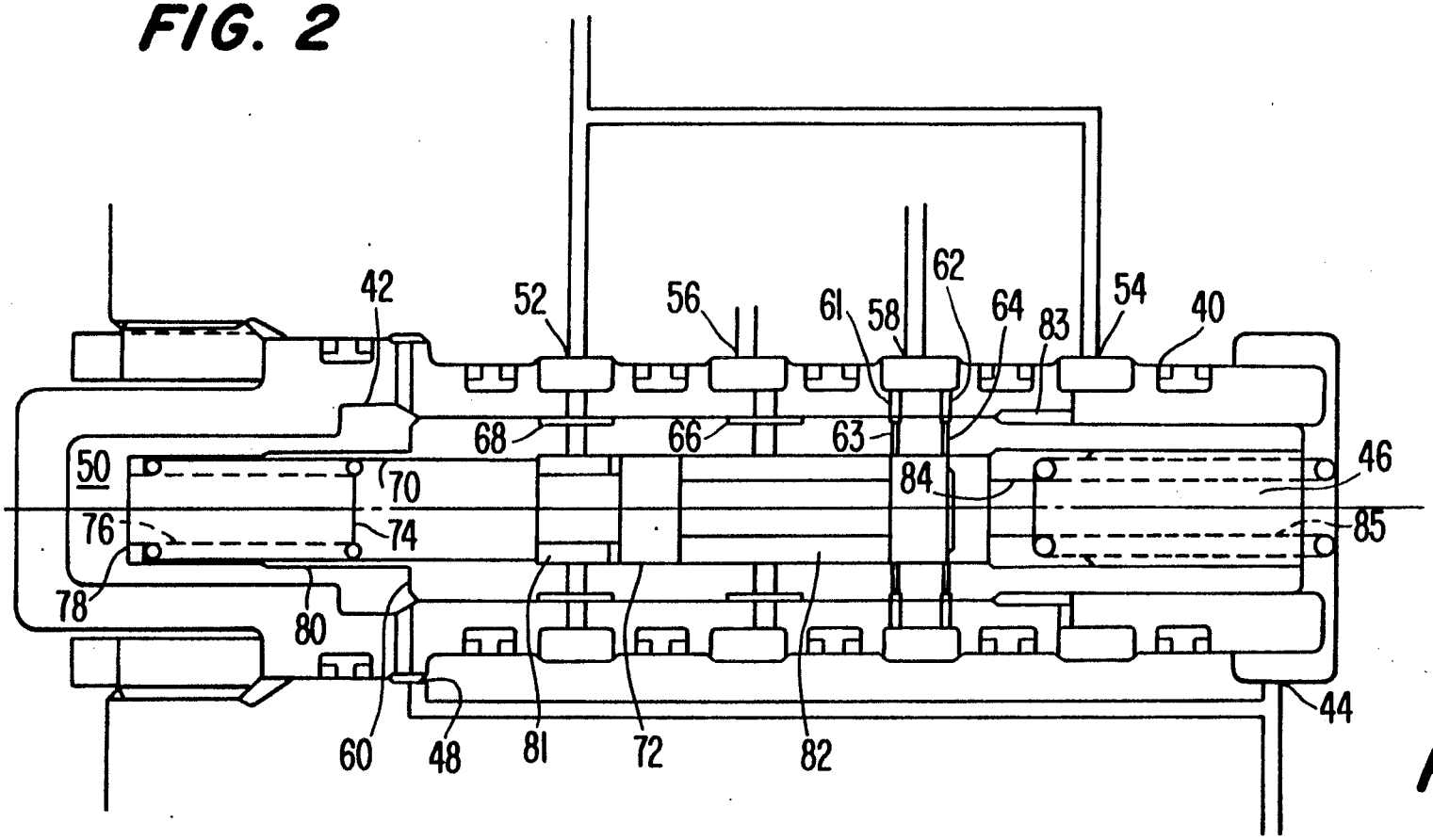
FIG. 2 illustrates the adaptive stepped compensator valve of the present invention.

The adaptive stepped compensator valve of the present invention is illustrated in detail in FIG. 2. The adaptive stepped compensator valve of the present invention includes a housing 40 having an elongated bore 42 formed therein and a plurality of ports formed in the housing 40.

A first input port 44 is provided for inputting a first portion of a flow of the high pressure fluid at a first end 46 of the elongated bore 42. A second input port 48 is provided for inputting a second portion of the flow of high pressure fluid at a second end 50 of the elongated bore 42. A third input port and an optional fourth input port 52 and 54, respectively, disposed between the first and second input ports 44 and 48, respectively, are provided for inputting first and second portions, respectively, of a flow of low pressure fluid. A return port 56, disposed between the first and second input ports 44 and 48, respectively, is provided for returning fluid to a fluid reservoir. A control port 58, disposed between the first and second input ports 44 and 48, respectively, is provided for outputting a control signal to the hydraulic motor.

The adaptive stepped compensator valve of the present invention includes a sleeve 60 movably positioned in an axial direction in the elongated bore 42. The sleeve is disposed in sealed slidable engagement with the housing 40. The sleeve 60 includes a plurality of channels for correspondingly communicating with the third input port 52, the return port 56, and the control port 58.

Destroke and stroke control ports 61 and 62 are provided in spaced apart relationship to each other in the housing 40. The destroke and stroke control ports 61 and 62 communicate with the control port 58.

Destroke and stroke control channels 63 and 64 are provided in spaced apart relationship to each other in the sleeve 60. The destroke and stroke control channels 63 and 64 correspond and communicate with the destroke and stroke control ports 61 and 62. A return channel 66 is provided in the sleeve 60 for communicating with the return port 56. The return channel 66 is designed to always remain in communication with the return port 56 when the sleeve 60 is moved. A third input channel 68 is also provided in the sleeve 60 for communicating with the third input port 52. The third input channel 68 is designed to remain in communication with the third input port 52 when the sleeve 50 is moved.

An opening 70 is formed in the sleeve 60 extending the complete length of the sleeve 60. Each of the channels of the sleeve 60 communicates with the opening 70.

The adaptive stepped compensator valve of the present invention includes a direct acting main spool 72 which is movably positioned in an axial direction in the opening 70 of the sleeve 60 and is disposed in sealed slidable engagement with the sleeve 60 to form a first chamber in the first end 46 of the elongated bore 42.

The main spool 72 controls the flow of fluid through the control port 58 by opening either the destroke or stroke control channel 63 or 64 and closing the other control channel 63, 64 and varying the opening of the opened control channel 63, 64 when the main spool 72 is axially moved. The high pressure fluid inputted by the first input port 44 into the first chamber at the first end 46 of the elongated bore 42 generates a first force which is applied to the main spool 72 and the sleeve 60 in a first direction.

A balance spool 74 is also provided in the adaptive stepped compensator valve of the present invention. The balance spool 74 has a diameter smaller than the main spool 72. A first end of the balance spool 74 abuts a first end of the main spool 72. The balance spool 74 is movably positioned in an axial direction in the opening 70 of the sleeve 60 and is disposed in sealed slidable engagement with the sleeve 60 to form a second chamber in the second end 50 of the elongated bore 42. The high pressure fluid inputted by the second input port 48 into the second chamber of the elongated bore 42 generates a second force which is applied to the balance spool 74 and the sleeve 60 in a second direction opposite to that of the first direction of the first force applied to the main spool 72 and the sleeve 60.

The adaptive stepped compensator valve of the present invention further includes a first small spring 76 having a first end which abuts a second end of the balance spool 74. A second end of the first small spring 76 abuts restraining apparatus integral with the sleeve 60. The restraining apparatus includes a ring 78 attached to an extending portion 80 which extends from the sleeve 60. The second end of the first small spring 76 abuts the ring 78.

The first small spring 76 is provided for biasing the balance spool 74 against forces applied to the balance spool 74 in the first direction. The first small spring 76 is of a small size relative to springs used in conventional direct acting compensator valves and is merely provided to fine tune the adaptive stepped compensator valve of the present invention.

The first end of the main spool 72 which abuts the first end of the balance spool 74 is indented forming a third chamber 81 with the first end of the second spool and the sleeve 60. Low pressure fluid is inputted into the third chamber 81 from the third input port 52. The low pressure fluid inputted to the third chamber 81 generates forces on the main spool 72 and the balance spool 74. The forces generated by the pressure in the third chamber 81 are applied to the main spool 72 in the second direction. Also the pressure in the third chamber 81 applies a force to the balance spool 74 in the first direction.

The low pressure fluid in the third chamber 81 serves to supply the valve with a pressure signal indicative of the low pressure fluid supplied to the adaptive stepped compensator valve of the present invention. The present invention makes use of this pressure signal to detect a difference in pressure between the high pressure fluid and the low pressure fluid to thereby cause axial movement of the main and balance spools 72 and 74, respectively, to control the control signal output through the control port 58.

An indentation is also provided in the middle portion of the main spool 60 forming a fourth chamber 82 with the sleeve 60. The fourth chamber 82 permits fluid to flow to a fluid reservoir (not shown) through the return port 56.

The sleeve 60 includes an optional indentation adjacent to the optional fourth input port 54 forming a fifth chamber 83 with the housing 40. The fifth chamber 83 receives low pressure fluid from the fourth input port 54.

The sleeve 60 also includes a ledge 84 for restraining a second small spring 85 in a confined manner to abut the housing 40. The second small spring 85 serves to finely tune the balance of the forces acting on the spools.

The adaptive stepped compensator valve of the present invention basically operates by detecting differences in pressure between the high pressure fluid provided by the first and second input ports 44 and 48, respectively, and the low pressure fluid provided- by the third and fourth input ports 52 and 54, the high pressure fluid and the low pressure fluid causes the main and balance spools 72 and 74 to move in an axial direction relative to the sleeve 60 thereby opening either the destroke or stroke control channels 63 and 64 and closing the other control channel and varying the opening of the opened control channel.

Opening either the destroke or stroke control channels 63 and 64 and closing the other control channel and varying the opening of the opened control channel causes a variance in pressure of the control signal outputted by the control port 58. A variance in pressure of the control signal outputted by the control port 58 controls the operation of the hydraulic motor.

Movement of the main and balance spools 72 and 74 in the leftward direction opens the stroke control channel 64 and closes the destroke control channel 63 thereby permitting high pressure fluid from the first chamber to flow through the stroke control channel 64 to the control port 58. Movement of the main and balance spools 72 and 74 in the rightward direction opens the destroke control channel 63 and closes the stroke control channel 64 thereby permitting fluid to flow through the destroke control channel 63 to the fourth chamber 82. The fourth chamber communicates with the return channel 66 and the return port 56.

The adaptive stepped compensator valve of the present invention provides an adaptive operational feature which permits the present invention to adapt to varying pressures and a stepped operational feature which provides for the balancing of the valve of the present invention by the use of the high pressure fluid at both ends of the valve.

Figure 3:
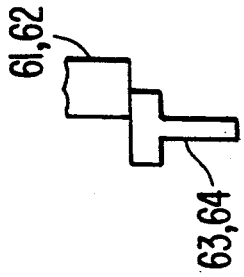
FIG. 3 illustrates the destroke/stroke control channels and the destroke/stroke control parts of the present invention.

The adaptive operational feature of the present invention is accomplished by movement of the sleeve 60 in the axial direction which varies the opening between either the destroke control channel 63 or the stroke control channel 64 as shown in FIG. 3. As shown in FIG. 3 movement of the sleeve in the leftward direction causes the opening between the destroke/stroke control channel 63, 64 and the destroke/stroke control port 61, 62 to become reduced.

The variance in the opening between the destroke/-stroke control channel 63, 64 and the destroke/stroke control port 61, 62 permits the present invention to easily adapted to varying control pressures by controlling the range of flow gains of the control system. A lower flow gain, defined as fluid flow per pressure unit, is desired to maintain control stability when the system is subjected to higher than nominal supply pressures. Flow gain is reduced when the destroke/stroke control channels 63, 64 respectively begin to cover the fixed destroke/stroke control ports 61, 62.

The stepped operational features of the present invention is accomplished by the force exerted by the balance spool 74 in the second direction on the main spool 72. The force exerted by the balance spool on the main spool 72 is caused by the second force generated by the high pressure fluid in the second chamber of the elongated bore 42. The second force generated by the high pressure in the second chamber of the elongated bore 42 is applied to the balance spool in the second direction.

The second force generated by the balance spool 74 on the main spool 72 balances the valve being that the first force generated by the high pressure fluid in the first chamber of the elongated bore 42 is much larger than the forces generated by the low pressure fluid in the third chamber 81.

In conventional systems a large spring is typically applied to the main spool to supplement the force generated by the low pressure fluid as shown in FIG. 1. The large spring compensates for the large difference in pressure generated by the low pressure fluid and the high pressure fluid. The large spring used to balance the valve in conventional systems becomes even larger when the valve is to be used in a system which operates in the range of 5,000–8,000 psi.

The present invention eliminates the use of such large springs by balancing the valve of the present invention by the use of the high pressure fluid at opposite ends of the valve.

While the present invention has been described in terms of its preferred embodiment it should be understood that numerous modifications may be made thereto without departing from the spirit and scope of the invention as defined in the appended claim. For example, the present invention may be used in any application which requires a balanced compensator valve that does not require the use of large size springs to perform the balancing. It is intended that all such modifications fall within the scope of the appended claims.

We claim:

1. An adaptive stepped compensator valve for controlling hydromechanical control apparatus having high and low pressure control lines, said valve comprising a housing having an elongated bore formed therein;

a plurality of ports are formed in said housing including a first input port for inputting a first portion of high pressure fluid flowing in said high pressure control line at a first end of said elongated bore, a second input port for inputting a second portion of said high pressure fluid flowing in said high pressure control line at a second end of said elongated bore, a third input port, disposed between said first and second input ports, for inputting a portion of low pressure fluid flowing in said low pressure control line, a control port, disposed between said first and second input ports, for outputting a control signal to control said apparatus and stroke and destroke control ports which communicate with said control port;

a sleeve movably positioned in an axial direction in said elongated bore and being disposed in sealed slidable engagement with said housing, said sleeve having an opening formed therein extending the length of said sleeve, a third channel which communicates with said third input port and stroke and destroke control channels which correspondingly communicate with said stroke and destroke control ports; and direct acting main and balance spools;

said main spool having a first end and being movably positioned in an axial direction in said opening of said sleeve and disposed in sealed slidable engagement with said sleeve to form a first chamber in said first end of said elongated bore, wherein said main spool controls the flow of fluid through said control port by opening said stroke control channel and closing said destroke control channel or opening said destroke control channel and closing said stroke control channel, wherein said high pressure fluid being inputted by said first input port generates a first force in said first chamber, said first force is applied to said main spool in a first direction;

said balance spool, having a first end which abuts a second end of said main spool, and being movably positioned in an axial direction in said opening of said sleeve and disposed in sealed slidable, engagement with said sleeve to form a second chamber in said second end of said elongated bore, wherein said high pressure fluid being inputted by said second input port generates a second force in said second chamber, said second force is applied to said balance spool in a second direction;

wherein said portion of said low pressure fluid inputted by said third input port generates forces in a third chamber formed by said second end of said main spool, said first end of said balance spool and sleeve; and wherein a difference in pressure between said high pressure fluid and said low pressure causes axial movement of said main and balance spools thereby permitting fluid to flow through said stroke control channel or said destroke control channel, whereby said valve adapts to varying pressures by axial movement of said sleeve and said valve is balanced by using high pressure fluid in said first and second chambers at opposite ends of said valve.

2. The adaptive stepped compensator valve, according to claim 1 wherein said second of said main spool is indented forming said third chamber with said first end of said balance spool and said sleeve.

3. The adaptive stepped compensator valve, according to claim 2, wherein said third channel corresponding to said third input port is formed such that said third input channel remains in communication with said third input port when said sleeve is moved.

4. The adaptive stepped compensator valve, according to claim 1, wherein a middle portion of said main spool is indented forming a fourth chamber with said sleeve.

5. The adaptive stepped compensator valve, according to claim 4, wherein said fourth chamber communicates with a return port through a return channel of said sleeve corresponding to said return port.

6. The adaptive stepped compensator valve, according to claim 5, wherein said return channel corresponding to said return port is formed such that said return channel remains in communication with said return port when said sleeve is moved.

7. The adaptive stepped compensator valve, according to claim 6, wherein said fourth chamber moves with said main spool and when said fourth chamber is moved in said second direction said fourth chamber establishes communication with said destroke control channel of said sleeve.

8. The adaptive stepped compensator valve, according to claim 1 further comprising:

a spring, disposed in said second end of said elongated bore, having a first end which abuts a second end of said balance spool, said spring finely tunes the balance of said valve.

9. The adaptive stepped compensator valve, according to claim 8, wherein said spring is restrained by restraining apparatus integral with said sleeve.

10. The adaptive stepped compensator valve, according to claim 9, wherein said restraining apparatus comprises:

an extending portion which extends from said sleeve; and a ring attached to said extending portion, wherein a second end of said spring abuts said ring.

11. The adaptive stepped compensator valve, according to claim 1 further comprising:

a spring, disposed in a first end of said elongated bore, and having a first end abutting said housing and a second end abutting a ledge portion attached to said sleeve;

wherein said spring finely tunes the balance of said valve.

12. The adaptive stepped compensator valve, according to claim 1, wherein said sleeve is indented forming a fifth chamber with said housing.

13. The adaptive stepped compensator valve, according to claim 12, wherein said fifth chamber communicates with a fourth input port which inputs a second portion of said flow of low pressure fluid, said fifth chamber receives said second portion of said flow of low pressure fluid from said fourth input port.

14. The adaptive stepped compensator valve, according to claim 13, wherein said second portion of said flow of low pressure fluid received by said fifth chamber generates a force which is applied to said sleeve in said first direction.

15. The adaptive stepped compensator valve, according to claim 1, wherein said balance spool has a diameter smaller than said main spool.

16. The adaptive stepped compensator valve, according to claim 7, wherein said main spool includes an end portion which closes said destroke control channel and opens said stroke control channel of said sleeve when said main spool is moved in said first direction and opens said destroke control channel and closes said stroke control channel when said main spool is moved in said second direction.

* * * * *